US010683196B2

(12) United States Patent
Eaton et al.

(10) Patent No.: US 10,683,196 B2
(45) Date of Patent: Jun. 16, 2020

(54) PORTABLE TURNTABLE AND WINCH

(71) Applicant: Woods Hole Oceanographic Institution, Woods Hole, MA (US)

(72) Inventors: Joshua A. Eaton, Woods Hole, MA (US); James A. Haley, Woods Hole, MA (US)

(73) Assignee: Woods Hole Oceanographic Institution, Woods Hole, MA (US)

( * ) Notice: Subject to any disclaimer, the term of this patent is extended or adjusted under 35 U.S.C. 154(b) by 607 days.

(21) Appl. No.: 14/963,570

(22) Filed: Dec. 9, 2015

(65) Prior Publication Data

US 2016/0167747 A1 Jun. 16, 2016

Related U.S. Application Data

(60) Provisional application No. 62/090,672, filed on Dec. 11, 2014.

(51) Int. Cl.
*B66D 1/36* (2006.01)
*B66D 1/28* (2006.01)

(52) U.S. Cl.
CPC ..... *B66D 1/365* (2013.01); *B66D 1/28* (2013.01)

(58) Field of Classification Search
CPC ..... B66D 1/28; B66D 1/365
See application file for complete search history.

(56) References Cited

U.S. PATENT DOCUMENTS 1,535,221 A * 4/1925 Hansen ..... B66D 3/02 248/349.1
3,664,515 A * 5/1972 Orendorff ..... B66C 23/94 104/47
3,937,415 A * 2/1976 Prinz ..... A01K 89/0165 242/297
4,050,587 A * 9/1977 Moen ..... B66C 23/48 212/301
4,371,147 A * 2/1983 Ridgway ..... B60P 3/035 254/326
4,896,686 A * 1/1990 Schmidt, Jr. ..... B08B 9/043 134/167 C
5,636,648 A * 6/1997 O'Brien ..... B08B 9/04 134/107
6,199,442 B1 * 3/2001 Bauer ..... B66C 23/94 188/31
2011/0291061 A1 * 12/2011 Costas ..... B66D 1/28 254/332
2014/0070553 A1 * 3/2014 Weidner ..... B66D 1/00 293/117

* cited by examiner

*Primary Examiner* — Sang K Kim
*Assistant Examiner* — Nathaniel L Adams
(74) *Attorney, Agent, or Firm* — Robert Devin Ricci; Russel O. Primeaux; Kean Miller LLP

(57) ABSTRACT

A portable, lightweight, and low relief profile turntable is equipped for the universal mounting of different winches and winch-type apparatus suitable for use on the deck of a ship or other surface. The turntable is capable of mounting to an increased number of potential locations on deck where it may be easily manipulated to achieve a useful direction and an optical fleet angle.

18 Claims, 13 Drawing Sheets

PORTABLE TURNTABLE AND WINCH

CROSS REFERENCE TO RELATED APPLICATIONS

This application claims priority to and the benefit of U.S. Provisional Patent Application Ser. No. 62/090,672, filed Dec. 11, 2014, the disclosure of which is hereby incorporated herein by reference in its entirety.

FIELD OF THE INVENTION

The present invention relates to an improved low profile portable turntable for securely mounting a winch or other apparatus to a surface such as the deck or a ship or flat bed of a vehicle. The invention enables installation, removal, and rotational repositioning of the apparatus with minimal effort.

BACKGROUND OF THE INVENTION

Winches are used to retrieve line and to provide hauling forces such as is needed to deploy mooring lines, floats, buoys, and vehicles onto the deck of a ship. Shipboard winches generally require secure placement to adequately handle heavy load demands and to resist the constant motion of the seas. For this reason, it is common practice for shipboard winches to be secured to base plates which are permanently welded to the deck of the ship. The installation of winches and winch mounting systems or repositioning or adjustment of the winch angle following winch installation generally requires a robust hoist or other lifting means to elevate, move, or rotate the apparatus into position.

Because deck space is limited on ocean-going vessels, and once installed, repositioning of winches is difficult if not impossible during a voyage, base plates are generally custom fabricated for a specific voyage, taking into account the likely orientation and location of use of the winches for that specific operation. The custom base plates are then welded to their specified position on the deck, and the winch is firmly attached for the duration of the time at sea. Subsequent missions may require different winch positions which results in the disposal of the customized base plates as well as a loss of time, labor, and money.

During operation, a winch is often used in conjunction with sheaves and/or flanges. In order to ensure minimum stress and wear on the winch line, it is preferable to maintain an optimal fleet angle (i.e., the angle of the winch line between the sheave and the drum of the winch). In most cases, the optimum fleet angle is ninety degrees (e.g., the winch line is perpendicular to the winch drum). Therefore, the base plates must be precisely designed and positioned to ensure that the desired angle is achieved when the mounted winch is in use.

Winch fixation to the platform prohibits repositioning while at sea and significantly reduces the adaptability of a winch for multiple uses, often resulting in the need for multiple winches in order to accommodate a variety of shipboard hauling needs. Consequently, it is not uncommon that more than one size or type of winch must be mounted on deck in order to complete specific shipboard tasks, but installation requirements severely limit the potential number of different winch types which may be used. Likewise, the presence of installed winches also limits the deck space available for other equipment.

Cranes are sometimes used to supplement the hauling needs of the ship. In most cases, a crane is permanently mounted to a specific portion of the deck and requires significantly more space to reliably support the boom. Although cranes have been previously associated with motorized turntables, such turntable assemblies and undercarriages used must be structurally reinforced in order to accommodate the height and weight requirements. The heavy duty nature of these turntables and their associated reinforcing structures necessitates that they occupy a high-relief from platform to the upper mounting surface. Thus, because of size and mounting requirements, crane-associated turntables 1) have a high relief (often greater than 1, 2, or 3 feet from the platform), 2) are not generally mission-portable, 3) require motorized power for operation, and 4) have a large footprint (typically greater than 4, 5, 10, 15, or 20 feet across), and furthermore are not generally suitable for support of a stand-alone winch without a boom. In contrast, the compact profile of a boom-less winch renders it more preferable to be mounted on a low-relief, portable turntable.

It would be of great value to have a portable turntable that can attach securely enough to the deck to handle the motions of the seas but can also be detached on site for movement elsewhere on the deck or to another platform. Additionally, an ability to instantly orient the angular position of a shipboard winch or to exchange winches on a single turntable would be advantageous.

While many other known turntables have been described, all rely on gear train and motor assemblies for rotational repositioning. Other described turntables of the art, particularly those of high-relief, must be mounted in a designated area or recessed cavity, limiting their portable aspects. The ability to rotate a heavy-duty turntable by hand minimizes fabrication costs and power requirements (i.e., by eliminating a motor) and time and complexity to reorient during use. Manual rotation consumes no power which is a commodity at sea and gives more precise control of rotation to obtain the optimum fleet angle.

Therefore, a need exists for a versatile winch mounting system that can accommodate the variety of winches brought aboard a ship, thereby mitigating the need for a specific mounting system for each winch type. This relieves space and reduces weight limitations while allowing more equipment to be available for deck use with less required infrastructure.

SUMMARY OF THE INVENTION

Described herein is an improved turntable and winch designed for mounting on a platform particularly the deck of a ship or vehicle. It is a particular advantage of the present system to provide a turntable that may be easily adjusted by the operator on the site of use without the additional assistance of mechanical force and may be quickly detached from the platform, moved to a new location, and remounted. The present invention includes a portable, variable orientation turntable and winch for mounting on a platform comprising a turntable comprising a base plate, a rotational element comprising a mounting plate interface and a base plate interface, a mounting plate, and a locking mechanism, and a winch in fixed orientation on a mounting surface of the mounting plate. In one embodiment, the mounting plate interface of the rotational element is attached to the mounting plate, and the base plate interface is attached to the base plate such that when the base plate is fixed to the platform, the mounting plate is rotatable around an axis perpendicular to the base plate. The locking mechanism may be positioned to simultaneously engage the base plate and the rotating mounting plate to reversibly limit rotation of the mounting plate, and the winch is attached to the mounting plate.

The rotational element is comprised of at least two independently moving components to permit to free rotation of the mounting plate with respect to the platform. Additionally, the rotational element comprises lock engagement elements capable of interacting with the locking mechanism. In one embodiment, the rotational element is a clewing bearing.

According to one aspect, the mounting plate allows for the removable attachment of one or more types of winches.

According to another aspect, at least one of the base plate and the mounting plate is composed of one or more of materials selected from steel, stainless steel, aluminum, cast iron, titanium, metal alloy, mechanical grade plastic, and any combination thereof. In one embodiment, at least one of the base plate and the mounting plate is of a thickness of 0.25 inches to 2 inches. In another embodiment, at least one of the base plate and the mounting plate is further modified by cutting away sections of plate to reduce the overall mass and weight. The mounting plate may comprise at least one opening to expose the lock engagement elements of the rotational element and permit the locking mechanism to enter into said opening thereby engaging with the lock engagement elements to restrict rotation of the rotational element.

According to another aspect of the present invention, the turntable and winch comprises a locking mechanism further including a lock plate, a lock spacer, and a key lock which comprises one or more locking members projecting in a radial arc and adapted to restrict rotation of the rotational element. The lock plate is connected to the key lock by means of the lock spacer, and the locking members are complementary to the lock engagement elements of the rotational element, and when the locking members and lock engagement elements are engaged, the mounting plate is restricted in rotation about the platform. In one embodiment, the lock mechanism is manually operated from the surface of the mounting plate to engage the lock engagement elements of the rotational element. In another embodiment, the winch does not comprise a boom or a boom-like structure.

According to another aspect, the invention includes a low relief shipboard turntable comprising a mounting plate, a rotational element comprising a mounting plate interface and a base plate interface, a base plate, and a locking mechanism wherein the mounting plate interface of the rotational element is attached to the mounting plate, and the base plate interface is attached to the base plate such that when the base plate is fixed to a platform, the mounting plate is rotatable around an axis perpendicular to the base plate. The locking mechanism may be engaged with the rotational element or an attachment thereto to prevent rotation of the mounting plate. In one embodiment, the mounting plate is located between 2 inches to 2 feet from a platform surface when the turntable is attached to the platform. In another embodiment, the turntable may be manually rotated when the locking mechanism is not engaged. The turntable may be relocated to another platform or location upon disengagement of the base plate form the platform. In one embodiment, the mounting plate allows for the removable attachment of one or more types of winches.

According to another aspect, the turntable includes a locking mechanism comprising a lock plate, a lock spacer, and a key lock which comprises one or more locking members projecting in a radial arc and adapted to restrict rotation of the rotational element. Additionally, the lock plate is connected to the key lock by means of the lock spacer, and the locking members are complementary to the lock engagement elements of the rotational element. When the locking members and lock engagement elements are engaged, the mounting plate is restricted in rotation about the platform.

In another embodiment, at least one of the base plate and the mounting plate is composed of one or more of materials selected from steel, stainless steel, aluminum, cast iron, titanium, metal alloy, mechanical grade plastic, and any combination thereof. In additional embodiments, the materials may be laminated in one or more protective coatings selected from zinc, chrome plating, paint, epoxy, and any combination thereof.

BRIEF DESCRIPTION OF THE DRAWINGS

The drawings described herein constitute part of this specification and includes an exemplary embodiment of the portable turntable and winch which may be embodied in various forms. It is to be understood that in some instances, various aspects of the invention may be shown exaggerated or enlarged to facilitate an understanding of the invention. Therefore, drawings may not be to scale.

DETAILED DESCRIPTION OF THE PREFERRED EMBODIMENTS

The portable and revolving turntable and winch described herein has improved operational flexibility compared to the fixed mounting winches of the art. The portability of the inventive turntable and winch accommodates choice in placement for use, both for the turntable and winch itself and of other machinery to be used on a specific platform. The invention is easily installed on a platform using removable fasteners and may easily be repositioned elsewhere on the platform or relocated to another platform. In addition to portability, the turntable and winch described herein may be rotated after installation to provide variability of winch direction (i.e., the direction perpendicular to the platform) according to need.

Figure 1:
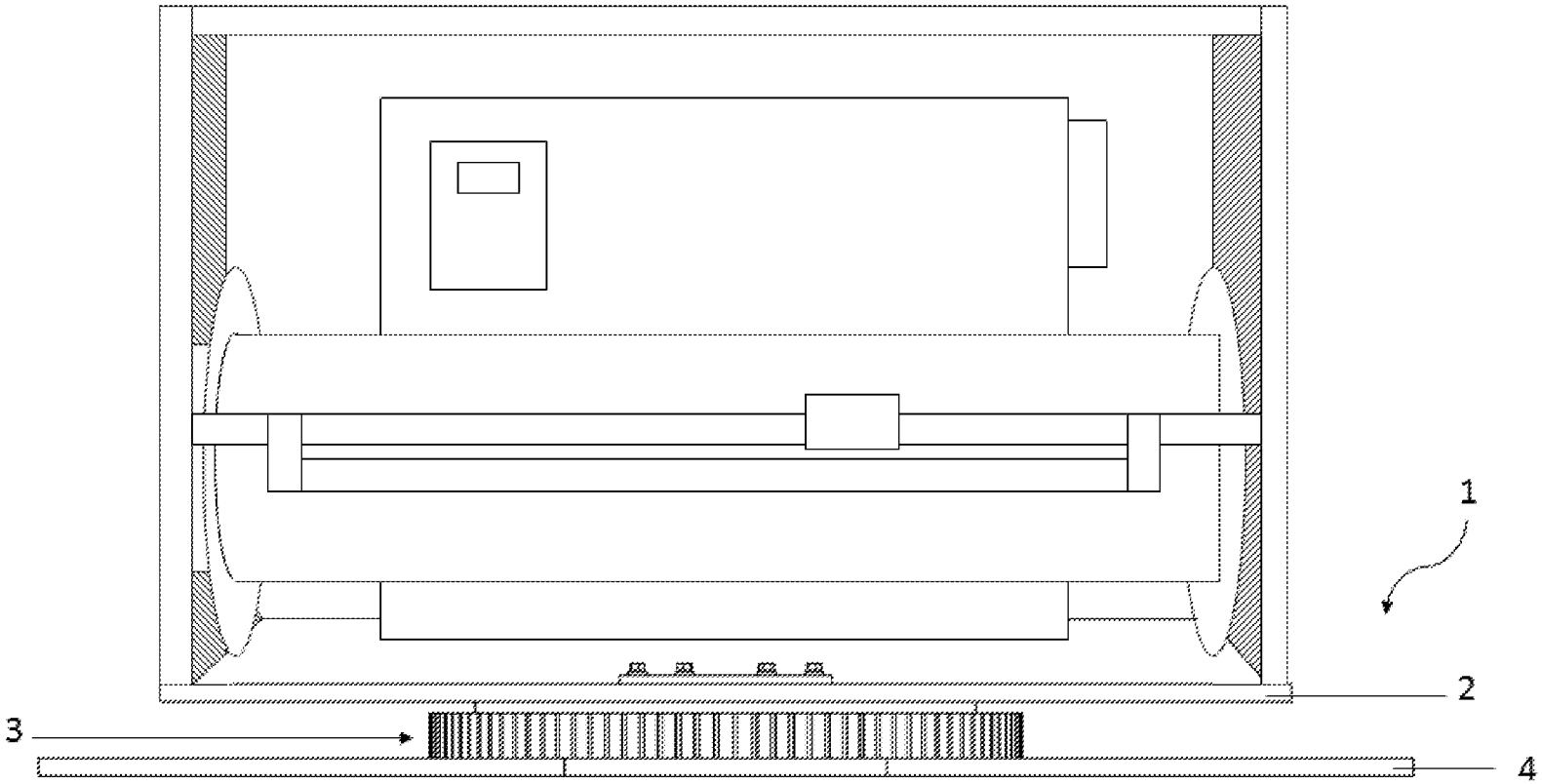
FIG. 1 illustrates a winch mounted on the turntable, according to an illustrative embodiment of the invention.
Figure 2:
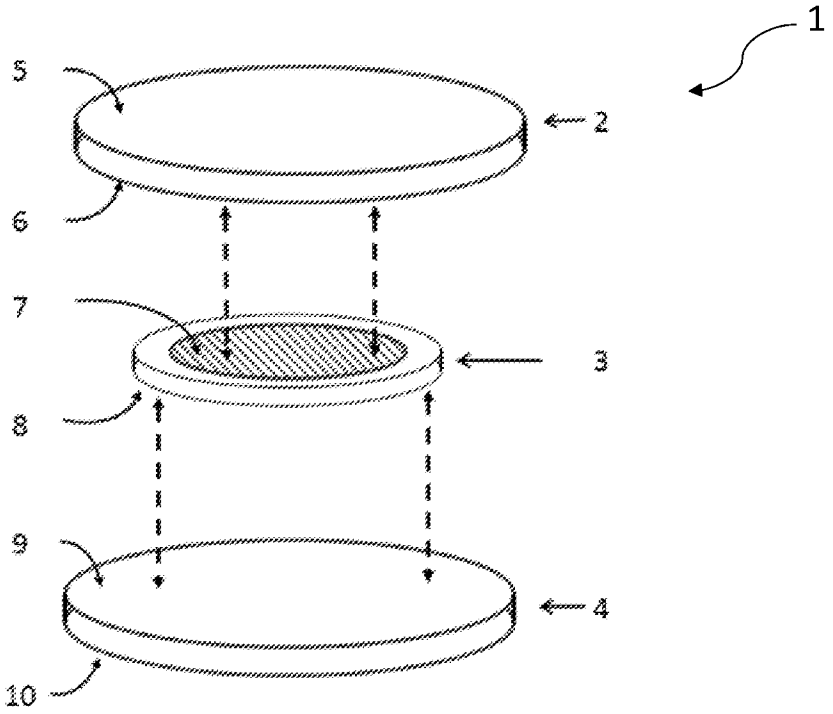
FIG. 2 depicts a schematic representation of each component and each surface of the turntable, according to an illustrative embodiment of the invention.

Any winch device suitable for the desired application (e.g., a levelwind winch, a drum winch, a mooring winch/spooler, a capstan, a windlass, a car puller, a hoist) may be used in conjunction with the inventive turntable 1 (FIG. 1). As shown in FIG. 2, the winch or other device is mounted to the mounting surface 5 of the mounting plate 2 of the turntable 1. The inner bearing surface 6 of the mounting plate 2 is affixed to the mounting plate interface 7 of rotational element 3. Rotational element 3 attaches to the outer bearing surface 9 of base plate 4 by means of base plate interface 8. Base plate 4 attaches to the platform via the platform surface 10.

Figure 3:
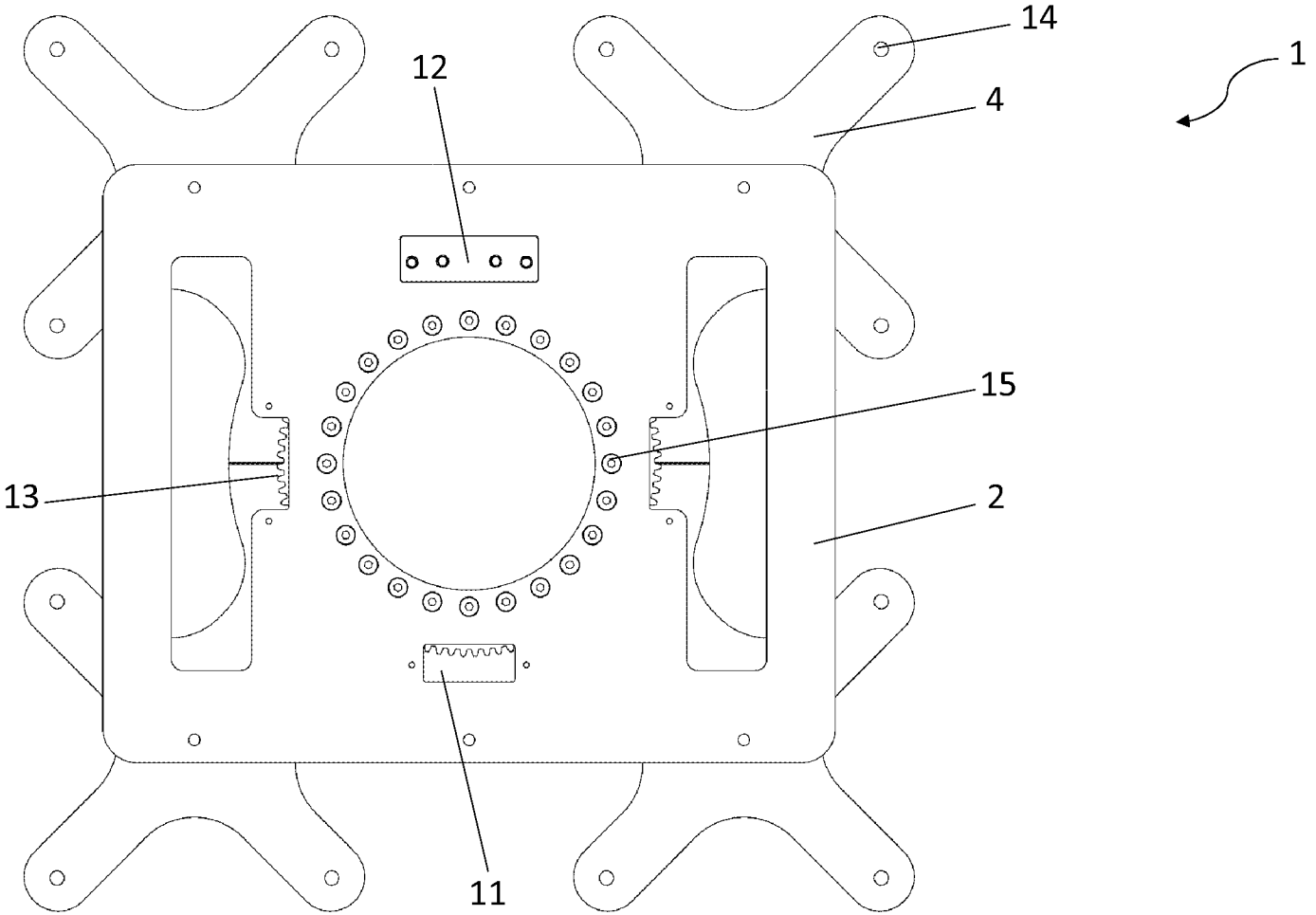
FIG. 3 schematically depicts an overhead view of a turntable, according to one embodiment of the invention.

As shown by the overhead view of the turntable 1 in FIG. 3, the suitable winch as recognized by one skilled in the art may be attaches to the mounting plate 2. When securely fastened to the platform, the winch and the mounting plate 2 rotate together with respect to the underlying base plate 4 secured to the platform. The turntable 1 may be rotated manually to allow for winch direction and/or fleet angle optimization.

The turntable and winch may be provided as separate components or as an integrated unit to be attached during platform installation. When fabricated as a separate entity, a winch may be fastened to the mounting surface 5 of the suitable turntable construction either reversibly or irreversibly using any anchoring elements 15 or other suitable fastening means including but not limited to certain fasteners described in more detail below.

Figure 4:
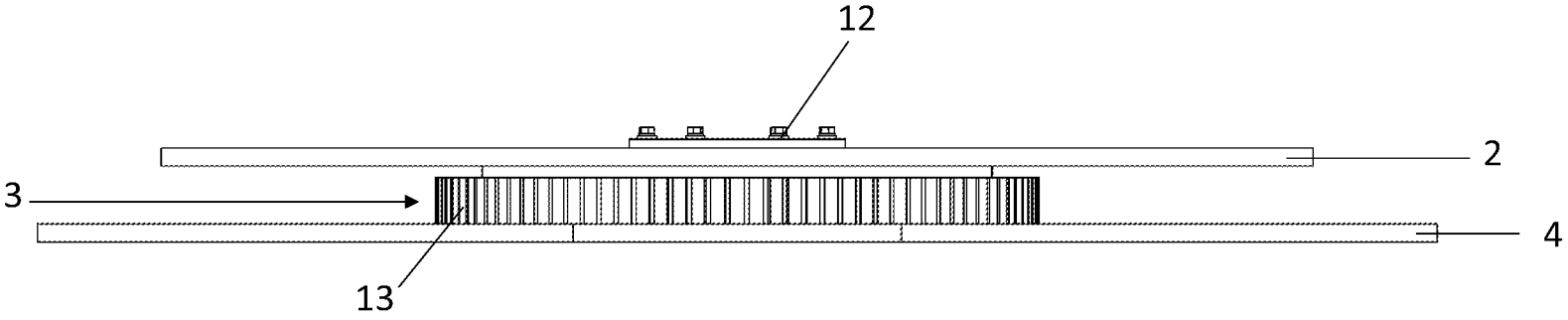
FIG. 4 depicts a side view of a turntable, according to an illustrative embodiment of the invention.

The inventive turntable and winch maintains a low relief contributed by the overall design and the use of a low profile rotational element 3 (FIG. 4). In other embodiments, the associated turntable is of a relief (e.g., height from the platform surface 10 to the mounting surface 5) of less than 2 feet, less than 1.5 feet, less than 1 foot, less than 8 inches, and in some instances, less than 4 inches. In another embodiment, the inventive turntable and winch is not associated with a boom (as with a crane construction). In another embodiment, the associated turntable 1 is without a structural undercarriage (e.g., counterweight, payload, upper boom weight support) suited for use with a boom mounted to the mounting surface 5. In such embodiment, the absence of a structural undercarriage substantially reduces the turntable weight and improves its portability.

The ability to reorient the winch direction by means of the associated turntable 1 is particularly advantageous for increasing the possible locations on deck to where the turntable 1 can be mounted and still achieve a useful direction and/or fleet angle for the winch line. In addition, the capability for manual and on the spot rotation of the turntable and winch allows for a more precise adjustment of the winch direction to obtain the optimum angle.

The preferred turntable and winch constructions may be rotated manually without the use of a motor, thereby allowing for adjustment of the winch direction as needed to accommodate line use in different directions without the need to unfasten the base plate 4, platform attachments, or otherwise change the winch location. A particular advantage of the present invention relates to precision of adjustment capable of the turntable 1. The precision may be expressed as angular resolution (i.e., the degree of rotation achieved when the turntable is adjusted about the axis of rotation). In certain embodiments, the turntable is capable of an angular resolution of at least 10 degrees, at least 8 degrees, at least 6 degrees, at least 4 degrees, at least 3 degrees, at least 2 degrees, or approximately 1.5 degrees, or less.

Following alignment to the desired direction, the locking mechanism 12 may be engaged to fix the winch direction. In one embodiment, the turntable 1 is used in a non-locked format, and the winch direction changes during use. More specifically, the platform (or the vehicle with the platform) changes its direction while the inventive turntable and winch is in operation, and the winch is rotated on the turntable 1 to hold an acceptable fleet angle of the line.

The turntable component of the invention may be designed to accommodate multiple winch types which may then be substituted and interchanged on a single turntable 1 according to need during a single voyage or job. Such interchangeability of winches and winch-types frees up otherwise winch-occupied deck space for other purposes. Similarly, the inventive turntable also negates the necessity to create customized base plates for each winch and each mounting situation. Winches suited for use with the inventive turntable 1 include, but are not limited to, the Hawboldt Ocean Research Winches (Models SPR-1640/S, SPRE 2232/S, SPR-1936/S, among others in the SPR product line), Dynacon Winches (Models P19, 10030, 599), MacArtney Winch and Handling Systems (Models MERMAC series R/S/A, CORMAC series Q/M/B, MASH series including MASH2000 and MASH4000), SeaMac (Model 207), and other winches designed for heavy to light duty operations. Such winches are often capable to handling working loads of approximately or at least 500 lbs, 1,000 lbs, 2,000 lbs, 3,000 lbs, 4,000 lbs, 5,000 lbs, 6,000 lbs, 7,000 lbs, 8,000 lbs, and 10,000 lbs. Another example of a winch appropriate includes the Compact Winch described in U.S. Provisional Patent Application No. 62/201,133 herein incorporated by reference in entirety.

Base Plate.

The invention is secured to a platform by means of a base plate 4. The base plate 4 secures and supports the turntable 1 and the mounted winch to the platform and resists deformation from the exerted hauling forces of the winch during operation. The platform is defined as any suitable structure to which the base plate 4 may be attached and held rigidly in place. In one instance, the platform is the deck of a ship or boat. Other possible platforms include the flatbed of a truck, trailer, train, or within the cargo hold of a plane or ship.

In general, the base plate 4 comprises at least two surfaces, the platform surface 10 and the outer bearing surface 9 (FIG. 2). When installed, the platform surface 10 contacts the platform, and the outer bearing surface 9 contacts and supports the base plate interface 8 of the rotational element 3. In most cases, both surfaces of the base plate 4 are flat, although in some embodiments, it is envisioned that the platform surface 10 will have specific relief and/or features meant to match, complement, or augment the features of the platform to which it is mounted.

The base plate 4 is generally a flat plate and may be of any suitable shape or size. When used with larger or heavy duty winches, the base plate 4 is designed to match and support the winch and the increase in load. In some embodiments, the base plate 4 is approximately the same size footprint as the attached winch although portions of the base plate 4 (such as those shown in FIG. 3) may extend further past the footprint of the winch and/or mounting plate 2. In another embodiment, the base plate 4 is larger than the footprint of the winch mounted thereon to provide additional support of the winch.

Figure 5:
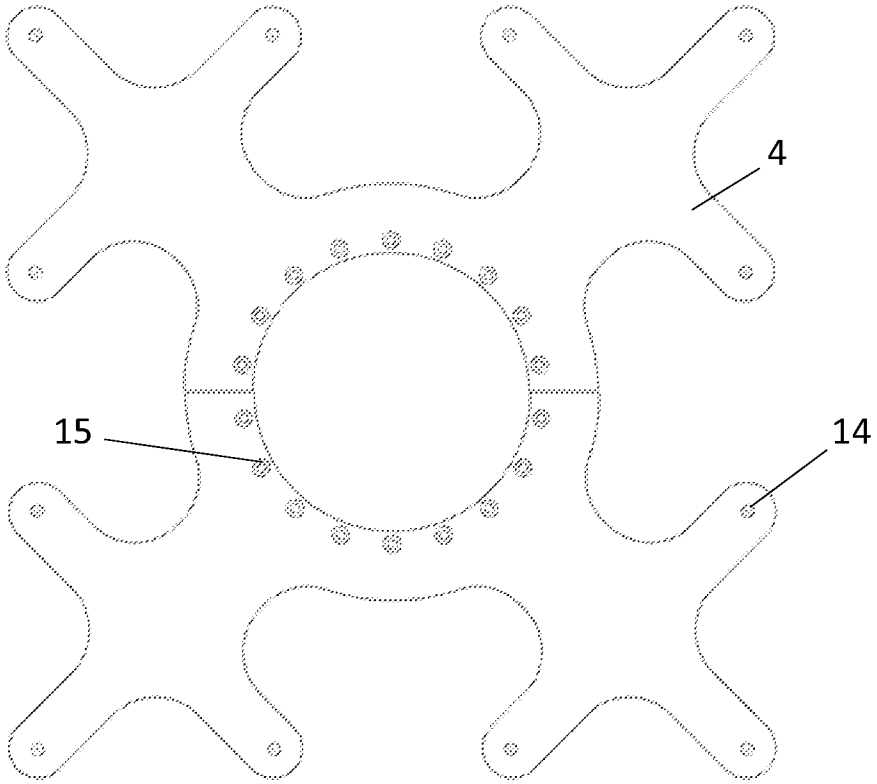
FIG. 5 illustrates an overhead view of a base plate, according to an illustrative embodiment of the invention.

While in some embodiments, the base plate 4 may be a uniform shape (e.g., rectangular, square, circular, ovoid, irregular shape), the present embodiment of FIG. 5 depicts the base plate 4 comprising cutaway regions. Such cutaways are positioned in such a manner as to still allow for alignment, maintenance of overall strength of the base plate 4, and secure attachment to the platform while utilizing a minimum amount of material. In certain embodiments, the base plate 4 comprises cruciform extensions. Although the base plate 4 may be of any shape capable of supporting the attached winch and its hauling load, this cruciform shape is optimized for least amount of material without compromise (e.g., loss of adherence) to platform attachment. These cruciform extensions of the base plate 4 often comprise one or more platform attachment points 14 positioned in each extensions, most often at the distal end of the extension. Most often, these attachment points 14 are holes to receive anchoring elements 15 (e.g., fasteners, nuts, bolts, pins, grooves, welds, rivets, or other fittings and the like) which project through said points 14 into the underlying platform. The base plate 4 is typically secured to the platform at multiple points, creating a rigid contact with the platform and equally distributing the prying forces from the mounted apparatus on the anchoring elements 15 during operation.

In most instances, the base plate 4 is secured to a platform using removable anchoring elements 15 such as bolts, quick release fasteners, or the like, allowing the turntable and the mounted apparatus to be quickly repositioned by detaching the anchoring elements 15 from the platform. Exact placement of and distance in between anchoring elements 15 may vary depending on surface of the platform. For most hauling needs, the turntable 1 is secured with a minimum of 4 anchoring elements 15, preferably with about 12 elements 15 (as shown in FIG. 5), and in some cases approximately 20 anchoring elements 15. However, suitable attachment may be dictated by one skilled in the art depending on the desired operation. The additional advantage for using removable anchoring elements 15 is that inspection, maintenance, or if necessary, repair of the base plate 4 or the rotational element 3 may be easily accomplished often on site of use. In other embodiments, the base plate 4 is attached to the platform by means of welds, rivets, or other means less removable than bolts.

In some cases, the platform has a matrix of points (e.g., pins, bolt holes, or perforations) to accommodate the anchoring of equipment to the platform such as the deck of a University-National Oceanographic Laboratory System (UNOLS) vessel which uses a specific anchoring point pattern universal to other UNOLS vessels. This pattern is often a two foot center spaced points for receiving anchoring elements 15. In one embodiment, the base plate 4 includes attachment points 14 designed to match to the UNOLS anchoring point pattern for turntable attachment. In other embodiments, the base plate 4 comprises platform attachment points 14 about its outer perimeter or any other position as deemed suitable by one in the art based on the platform for use to obtain an optimal amount of adhesion to the platform.

The base plate 4 can be fabricated as a single component or in halves (as shown in FIG. 3), quadrants, or other desired fragments which may assist in portability. The base plate 4 ranges in thickness from 0.25 inches to 1 or 2 inches; in some embodiments, the base plate 4 is between 2 and 6 inches thick.

Rotational Element.

The rotational element 3 permits the mounting plate 2 to rotate on an axis perpendicular with respect to the base plate 4. The rotational element 3 comprises at least two independently moveable parts and two surfaces—a base plate interface 8 and a mounting plate interface 7 (FIG. 2). The base plate interface 8 of the rotational element 3 may be attached to the base plate 4, and the mounting plate interface 7 maintains support for the mounting plate 2.

The rotational element 3 is disposed horizontally and attached to the base plate 4 and the mounting plate 2 by anchoring elements 15 distributed regularly to limit rotation to a fixed axis. In one embodiment, the rotational element 3 is attached to the base plate 4 and to the mounting plate 2 using bolts to allow secure attachment that can be removed for inspection or maintenance. In other embodiments, the rotational element 3 is attached to the base plate 4 and mounting plate 2 by anchoring elements 15 of welds, rivets, or other means less removable than bolts. The rotational element 3 may be permanently fused to one or both plates, but in most cases is attached by anchoring elements 15.

In an embodiment, the rotational element 3 is comprised of annular forms such as wheels, gears, bearings, or other similar components known to those in the art. Suitable such bearings with a large diameter provide a low vertical profile (as shown in FIG. 4), have minimal space and weight, and are capable of handling the heavy load of equipment affixed to the mounting plate 2. In general, the rotational element 3 allows for turning in either direction about the fixed axis, although in some embodiments, rotation is restricted to a single direction through the use of a directional locking mechanism such as a ratchet. Preferably, a rolling element bearing such as a slewing bearing is used. The slewing bearing offers several advantages including a low relief and a vertically compact construction, a high capacity for managing the heavy loads (often up to 5,000 lbs or even 10,000 lbs or more) associated with the winch and hauling needs, low structural stiffness for ease of manual rotation, and low cost. Additionally, slewing bearings are often fabricated for industrial purposes with one or more seals disposed between or around the bearing components to prevent the ingress of foreign matter as well as to maintain smooth rotation. Such bearings are also constructed in a wide range of diameters suitable for use in small to extra large turntables.

In one embodiment, the rotational element 3 is a single row ball slewing bearing to allow for a high level of rotational precision which is required to properly position the winch or the winch-type device. Other embodiments use other types of slewing bearings including two row ball bearings, cross roller bearings, or three ball roller bearings as appropriate to accommodate anticipated forces. In other embodiments, the rotational element 3 is a ball bearing, thin section bearing, thrust bearing, needle roller bearing, or other ball bearing. In most embodiments, the rotational element 3 has a thickness of less than 6 inches. In some embodiments, the thickness is less than 4, 3, 2, 1, or 0.5 inch. In still another embodiment, a portion or all of the rotational element is fabricated integral (e.g., inset) to either the base plate 4, the mounting plate 2, or both. In one embodiment of inset fabrication, the rotational element 3 is inset into one or both plates.

In many embodiments, the rotational element 3 comprises one or more lock engagement elements 13 dispersed circumferentially on either surface 7, 8, or the outer edge of rotational element 3. Most often, the lock engagement element or elements 13 are present on the surface of the rotational element 3 attached to the base plate 4. These elements 13, when engaged with the locking mechanism 12 prevent rotation of the turntable mounting plate 2 relative to the base plate 4 and/or platform. Lock engagement elements 13 may have any suitable form such as pins, teeth, grooves, holes, or notches such as straight-cut notches straight and aligned parallel to the rotational axis or helical notches aligned at a non-parallel angle to the rotational axis, such that they could be used to engage a worm gear. Other embodiments include double helical notches, bevel notches, spiral notches, or the like that may be appropriate for engagement of the rotational element 3. In another embodiment, said rotational element 3 does not contain external grooves along outer surface.

Lock engagement elements 13 need not be confined to the rotational means 3. These elements may be placed on any aspect of the turntable 1 which is meant to remain fixed during rotation of the mounting plate 2 (such as the base plate 4 or platform). More specifically, the lock engagement elements 13 may be present on the rotational element 3 or the attachments thereto. Suitable such attachments include the base plate 4, the platform, mounting plate 2, and any other aspects or elements of the winch.

In one or more embodiments of the inventive portable turntable and winch, the winch angle of operation is capable of being adjusted to any desired angle by hand, without the assistance of a motor. The lack of motor, gear train, power source, and additional accessories required to provide motorized rotation keeps the footprint and vertical profile of such embodiments as minimal as possible. Moreover, manual operation eliminates additional weight associated with the invention and eliminates electricity consumption during winch adjustment. In some embodiments, a motor is employed to assist rotation of the inventive turntable.

Mounting Plate.

The mounting plate 2 serves as the rotating surface to which the winch apparatus is secured to the turntable 1. The mounting plate 2 is generally composed of a mounting surface 5 for attaching the winch and an inner bearing surface 6 to attach to and pivot on the rotational element 3. The mounting plate 2 rotates around an axis perpendicular to the base plate 4. In many embodiments, the mounting plate 2 features one or more openings 11 (e.g., a fitted hole, a space, a tooth, or a notch) in the plate to engage the locking mechanism 12 (FIG. 3).

The mounting plate 2 is typically fastened to the rotational element 3 and to the winch using similar attachments and/or fasteners as previously described for the base plate 4. Suitable such attachments include anchoring elements 15 such as bolts, welds, rivets, pins, or the like. Depending on the specific winch to be used with the turntable, the exact arrangement and type of the anchoring elements 15 may vary in size, strength, thread count, etc. One embodiment allows for the mounting plate 2 to be attached at several points along the surface of the rotational element 3 (as shown in FIG. 3). In another embodiment and shown in FIG. 6, the mounting plate 2 has a series of anchoring points 20 (e.g., pins, bolt holes, or perforations) to accommodate anchoring of the winch to the mounting surface 5 using anchoring elements 15. Additionally, these anchoring points 20 may be regularly spaced along the perimeter of the mounting surface 2 to fasten the winch using said anchoring elements 15. In other embodiments, the anchoring points 20 are spaced at any desired point on the mounting plate 2. In a preferred construction similar to that stated for the base plate, the mounting plate 2 is also secured using removable anchoring elements 15 such as bolts for the same advantage of inspection and maintenance.

Figure 6:
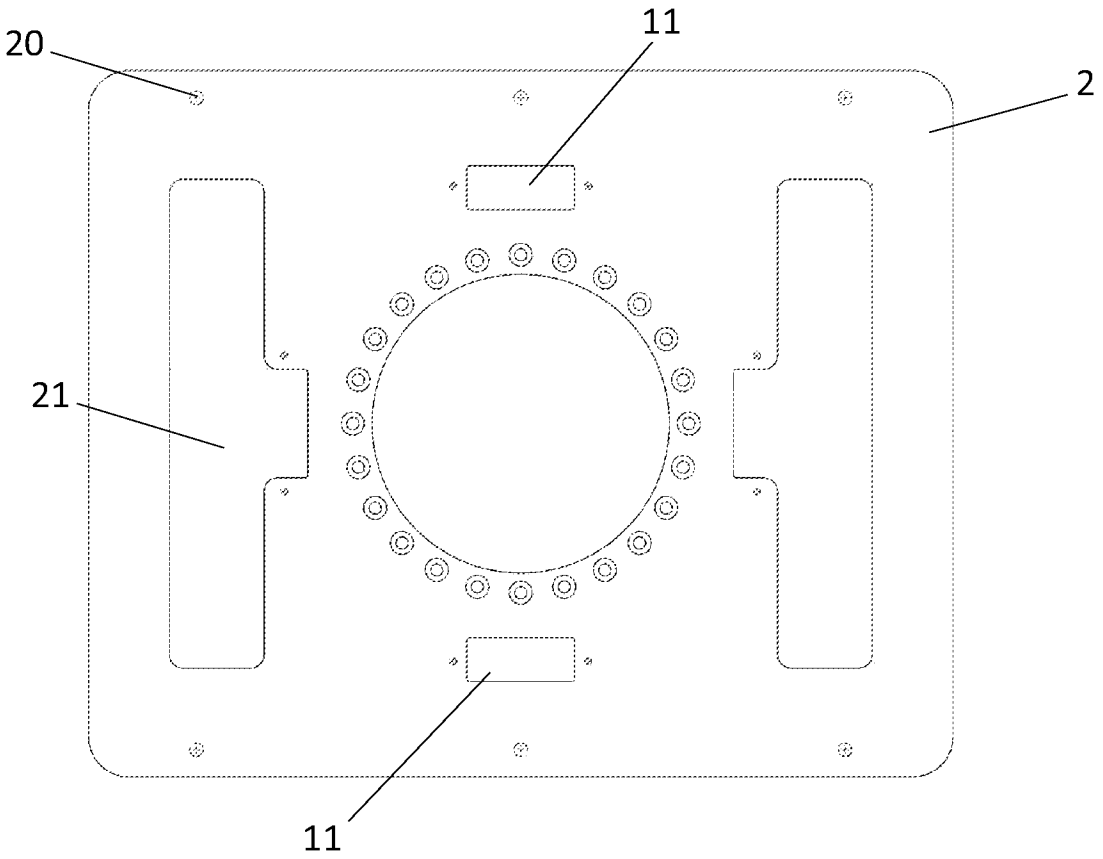
FIG. 6 depicts an overhead view of a mounting plate, according to one embodiment.

The mounting plate 2 should be of a shape and size suitable to accommodate a winch and/or the winch housing and other attachments or accessories. Additionally, the mounting plate 2 may be matched to the overall footprint of the base plate 4 or the winch. As illustrated in FIG. 6, the mounting plate 2 may be of a rectangular shape. In other embodiments, the mounting plate 2 is in the form of a circular or ovoid disk. In a construction similar to that of the base plate 4, the mounting plate may be rectangular or square with sections of the mounting plate 2 cut away, shown as space 21 (FIG. 6), to reduce the overall mass of the turntable 1 without a decrease in physical strength or durability under the weight of the mounted winch. The presence of cutaway sections should not be so great or of such a configuration so as to adversely affect the appropriate distribution of anchoring points 20 to attach the winch to the mounting surface 5. In many embodiments, the mounting plate 2 comprises one or more openings 11 to provide access of the lock engagement elements 13 on the rotational element 3 (or other surface). Said opening 11 may be of any suitable shape or size to allow the locking mechanism 12 to interact with the lock engagement elements 13 as described in more detail below. In certain embodiments, the mounting plate 2 comprises 2, 3, 4, 5, 6, and up to 10 openings 11 to engage a locking mechanism 12, although it may not be necessary to occupy each opening 11 with a locking mechanism 12.

The mounting plate 2 is generally less than 6 inches in thickness, most often less than 4, 3, 2, or 1 inch. Similar to the base plate 4, the mounting plate 2 can be fabricated as a single component or in halves, quadrants, or other desired fragments which may assist in portability.

Locking Mechanism.

While the turntable 1 may be manually rotated to provide any desired winch angle, many applications will require that the winch angle be rigidly maintained during winch operation. The locking mechanism 12 provides the means to reversibly prevent rotation of the moveable parts of the turntable 1 by simultaneous engagement with both a fixed and a moving portion of the turntable.

In some embodiments, the locking mechanism 12 simultaneously engages with the moveable mounting plate 2 or any attachment(s) thereto, and with the non-moveable base plate 4 or any attachment(s) thereto which in some embodiments may include parts of the ship or the platform. In additional embodiments, the locking mechanism 12 is a removable key or set of keys meant to reversibly restrict rotation of the mounting plate 2 (and attachments) with respect to the base plate 4 by simultaneously engaging a fixed portion of the rotational element 3 and the moveable mounting plate 2.

When placed in an open region 11 of the mounting plate 2, the locking mechanism 12 passes through the opening 11 and the locking members 19 enter and engage with the lock engagement elements 13 of the rotational element 3. The locking mechanism 12 is then held rigidly in place due to its engagement with the opening 11 passing through the mounting plate 2 and its engagement with the complementary lock engagement elements 13. So when engaged, the locking mechanism 12 prevents rotation of the mounting plate 2 relative to the base plate 4. In various embodiments, the mounting plate 2 accommodates 1 or more, 2 or more, or about 4 locking mechanisms 12 depending on the configuration and desired level of rigidity. In many embodiments, the locking mechanism 12 is engaged manually by the user, however other embodiments may allow the locking mechanism to be engaged through remotely controlled circuitry according to methods known in the art.

Figures 7A, 7B, 7C:
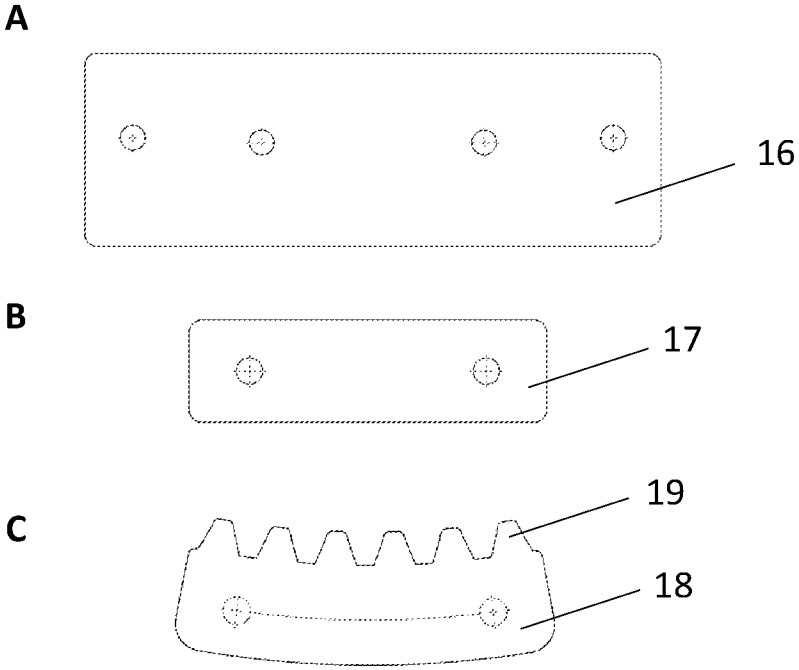
FIG. 7A-7C depicts a schematic of the components of the locking mechanism, according to one embodiment of the invention which includes (A) the lock plate, (B) the lock spacer, and (C) the key lock.

In one version of the embodiment, the locking mechanism 12 features at least a lock plate 16 (FIG. 7A) and a key lock 18 (FIG. 7C). The lock plate 16 provides a foundation to mount the key lock 18 in a fixed position. In other embodiments, the locking mechanism 12 also includes a lock spacer 17 (FIG. 7B). In this case, the lock plate 16 generally attaches to the lock spacer 17, and the lock spacer 17 mounts the key lock 18. In another embodiment, the locking mechanism 12 includes an optional grasp device disposed on the side of the lock plate 16 opposing of the key lock 18, and said grasp device allows for quick engagement/removal of the locking mechanism 12 by hand.

Although the size and shape of the lock plate 16 may vary, the lock plate 16 is generally designed to a size larger than the opening 11 in the mounting plate 2. Furthermore, the lock plate 16 is often, but not necessarily, of a similar shape to that of the opening 11 in the mounting plate 2. As shown in FIG. 3, an opening 11 provides the space in the plate 2 which allows access to the components of the turntable 1 below such as a fixed portion of the rotational element 3 (e.g., the lock engagement elements 13) and/or the base plate 4. The locking mechanism 12 may be inserted into one or more of these openings 11 to engage the lock engagement elements 13 and prevent rotation of the turntable 1. In some embodiments, the turntable 1 employs 1 or more, 2 or more, 3 or more, or 4 or more lock mechanisms to prevent turntable rotation.

In other embodiments, the lock plate 16 is of a form designed to fit closely within or fit flush with the opening 11 of the mounting plate 2 and of a dimension so that the attached key lock 18 mounted to the lock plate 16 (or lock spacer 17) may interact with the lock engagement elements 13 while allowing the grasp device attached to the lock plate 16 to be manipulated from the opposing side. In one embodiment, the locking mechanism 12 is operated from the surface of the mounting plate 2.

The lock spacer 17 is typically resides between the lock plate 16 and the key lock 18 to maintain and join the space between the two components. The lock spacer 17 may be any thickness which in many cases depends on the thickness of the mounting plate 2. Additionally, the lock spacer 17 is sized to fit within opening 11 with minimum additional space between the outer diameter of the lock spacer 17 and the inner diameter of the opening 11. In another embodiment, the lock spacer 17 fits loosely within opening 11 with 1 mm, 2 mm, 3 mm, 4 mm, up to 10 mm, up to 30 mm, or more between one or more points between the outer diameter of the lock spacer 17 and the inner diameter of the opening 11.

FIG. 7C depicts one embodiment of the key lock 18 wherein one lateral portion of the key lock 18 comprises locking members 19 capable of engaging the lock engagement elements 13 of the rotational element 3. The locking members 19 may be pins, grooves, holes, or notches but are most often in the form of gear teeth disposed in an arc and designed to match the radius and/or arc of, and interact with lock engagement elements 13 (e.g., external teeth) present on the rotational element.

Locking members 19 such as gear teeth and/or notches of the locking key should be of suitable shape and design (e.g., have suitable tooth thickness and tooth length) to withstand the rotational forces exerted by the turntable. Such gear teeth and/or notches may sometimes be comprised of a different material than the other aspects of the locking mechanism 12. In such instances, it may be advantageous for the teeth or notches to be heat-treated and/or tempered to harden the metal and add durability. For additional resistance to the surrounding environment, the locking members 19 may be coated with any suitable coating such as those coating described below.

Figure 9:
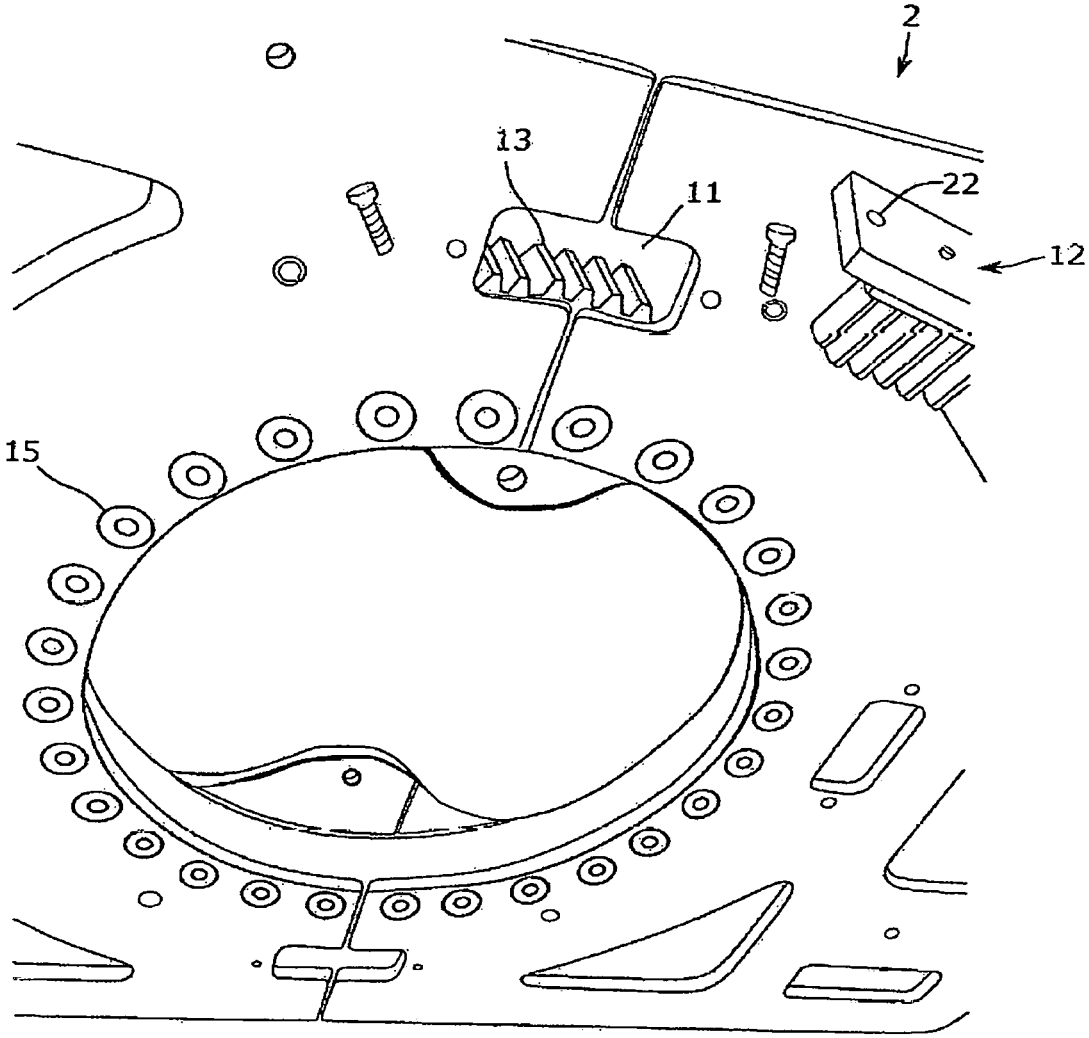
FIG. 9 depicts a view of a mounting plate, according to one embodiment and demonstrates how the locking mechanism moves in and out of engagement.

The locking mechanism 12 may also comprise a grasping device as known in the art (e.g., a handle, a grip, a loop, a strap, a knob) as a means for allowing a user to manually move the locking mechanism 12 in and out of engagement that may be integral with or attached to the lock plate 16 with fasteners (e.g., nuts, bolts, pins, grooves, or other fittings) of appropriate strength to serve as a means to easily engage and disengage the locking mechanism 12 by physically moving the lock in and out of the place on the turntable 1. For example, as depicted in FIG. 9, the locking mechanism 12 comprises a plurality of holes 22 at the lock plate 16 that allow for a wooden handle as known in the art to be inserted.

Another embodiment permits the locking mechanism 12 to interact with the rotational element 3 via the space created between the base plate 4 and the mounting plate 2. In another embodiment, the locking mechanism 12 engages the lock engagement elements 13 when the locking mechanism 12 is inserted from a side angle between the mounting plate 2 and the base plate 4. Furthermore, multiple locking mechanisms 12 may also contribute to the rotation impediment by engaging at such points surrounding the rotational element.

In another embodiment of the locking mechanism, rotation is restricted by a set of disc brakes. Said disc brakes engage a surface of the rotational element 3 possibly by compressing the outer periphery of the rotational element 3 and exerting enough frictional force to prevent movement about the axis. Such a locking mechanism would allow for varying degrees of rotational freedom depending upon the applied force. Disengaging disc brakes then alleviates the frictional forces and again permits rotational element 3 to turn.

In another embodiment, the locking mechanism comprises a machine key or set of machine keys which are set into place in slotted grooves. Slotted grooves are defined at multiple positions on both the base plate 4 and the mounting plate 2 as to enable suitable alignment of slotted grooves and allow the machine key or keys to pass through the mounting plate 2 to the base plate 4, creating a physical engagement of the mounting plate 2 and the base plate 4. Thus, independent rotational movement is restricted between said plates without directly interacting with the rotational element 3.

Rotation of the mounting plate 2 may be reestablished by disengaging the locking mechanism 12 and rotating the turntable 1 to the new desired winch direction. The locking mechanism 12 may then be re-engaged if desired.

General Material Considerations.

When the inventive turntable and winch is intended for ship board use, all parts will most often be fabricated from materials, or treated in such a way, that they will withstand the corrosive and oxidative aspects of the surrounding environment, while having fatigue properties suitable for the heavy load demands of use.

Generally speaking, the components of the invention including the base plate 4, mounting plate 2, and rotational element 3 are comprised of a solid material with the appropriate durability and strength required to support and maintain the attached devices in place during their intended use. Such materials must be of appropriate mechanical strength to withstand forces, such as tension and compression, which may be encountered during hauling procedures with the attached winch or during severe storms at sea.

In many cases, the base plate 4 and mounting plates 2 (i.e., the plates) are comprised of metal such as steel, stainless steel, aluminum, cast iron, titanium, metal alloys, mechanical grade plastics, or another composite material of similar solidity in a shape and thickness appropriate for load capacity required by the mounted apparatus. In one embodiment, one or both of the plates are composed of steel for reasons of strength and cost-effectiveness. However, said material may be composed from aluminum to reduce overall weight under lower force loads. In another embodiment, one or both of the plates are constituted from titanium for overall strength and resistance to corrosion in possible wet conditions. In some embodiments, one or both of the plates are comprised of corrosion-resistant materials.

The lock plate 16, lock spacer 17, and key lock 18 of the locking mechanism 12 may be comprised of appropriate material such as include steel, stainless steel, aluminum, cast iron, titanium, metal alloys, mechanical grade plastics or similar with same suitable strength necessary to resist deformation under the rotational forces of the turntable when locking means is engaged.

Component parts, fasteners, etc. may be laminated in a protective coating as to prevent corrosion and deterioration. Such coatings can include zinc, chrome plating, paint, epoxies, or similar coverings to the solid material. In an embodiment, the base plate and/or mounting plate is composed of a solid material which has been hot-dip galvanized. Another embodiment modifies the said material using electrogalvanization. Additionally, the coating may be paint or other resin such as epoxy paint. Chrome plating can also be considered a potential coating for the component parts.

The anchoring elements 15 are used in instances such as to attach a winch to the turntable 1 or to secure the turntable 1 to a platform. Such anchoring elements 15 may include bolts, nuts, rivets, welds, pins, or the like. Said anchoring elements 15 are composed of a material with sufficient strength and fatigue properties to maintain fastening integrity for the anticipated life of the turntable and/or winch, such as a metal or a metal alloy. Typical metals appropriate for fastening include steel, stainless steel, brass, aluminum, titanium, or other comparable material. For additional corrosion resistance, the anchoring elements 15 may be laminated with any suitable coating known in the art such as those coatings described above. In one embodiment, the invention uses bolt of a standard 1 inch diameter with 8 threads/inch.

Example 1

Figures 8A, 8B:
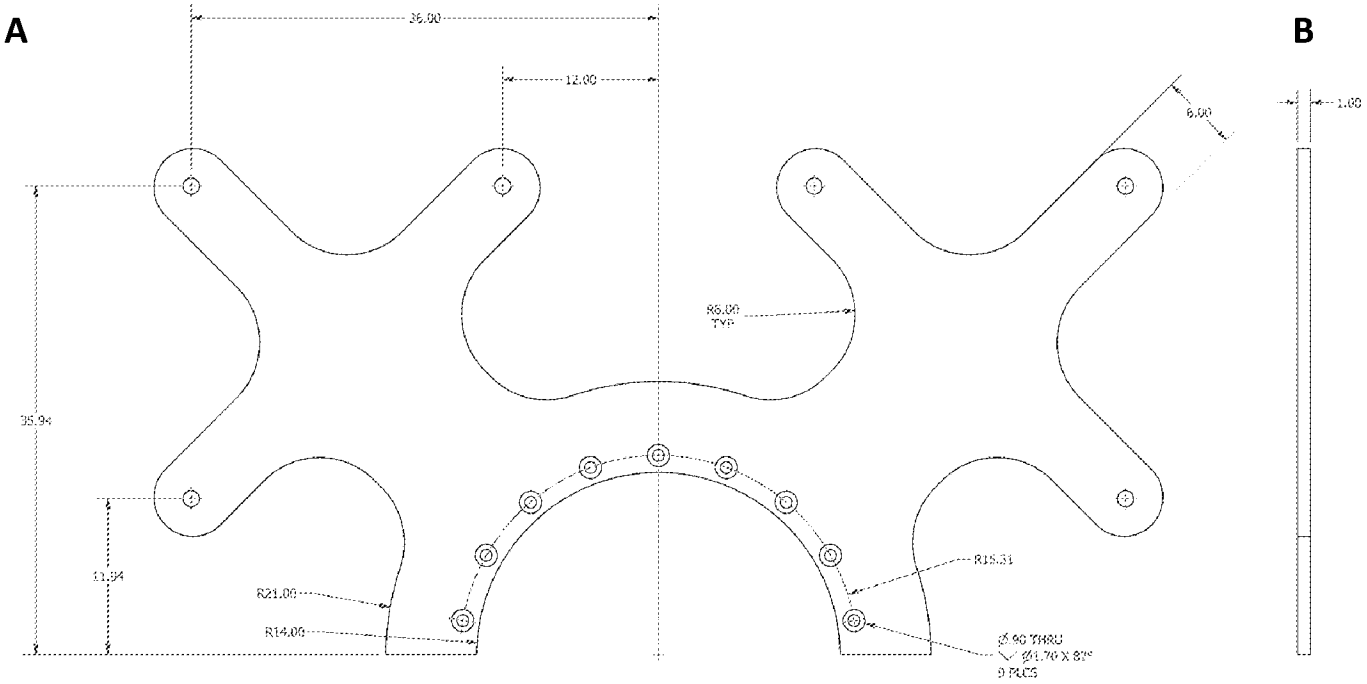
FIGS. 8A-8J depict one illustrated embodiment of the inventive turntable and detailed measurements (shown in inches) for each component including: (A) one portion of the base plate, (B) a side perspective depicting the thickness of the base plate, (C) the mounting plate, (D) a side perspective of the mounting plate depicting the thickness of the mounting plate, (E) the key lock, (F) a side perspective of the key'lock depicting the height of the key lock, (G) the lock spacer, (H) a side perspective of the lock spacer depicting the thickness of the lock spacer, (I) the lock base, and (J) a side perspective of the lock base depicting the thickness of the lock base.

Shown in FIGS. 8A through 8J, one specific embodiment of the inventive turntable may be constructed to the specified measurements. FIGS. 8A and 8B detail one half portion of the base plate measured in inches. Although the base plate may be fabricated in two halve components, such as two components of FIG. 8A, or four quarter components, the base plate may also be built from a single piece of material as is often the case in smaller footprint embodiments of the turntable. FIG. 8B depicts a side view of the base plate and the thickness of the plate which in this case is about 1 inch thick. In this instance, the base plate is constructed from steel or a metal of similar strength.

Figures 8C, 8D:
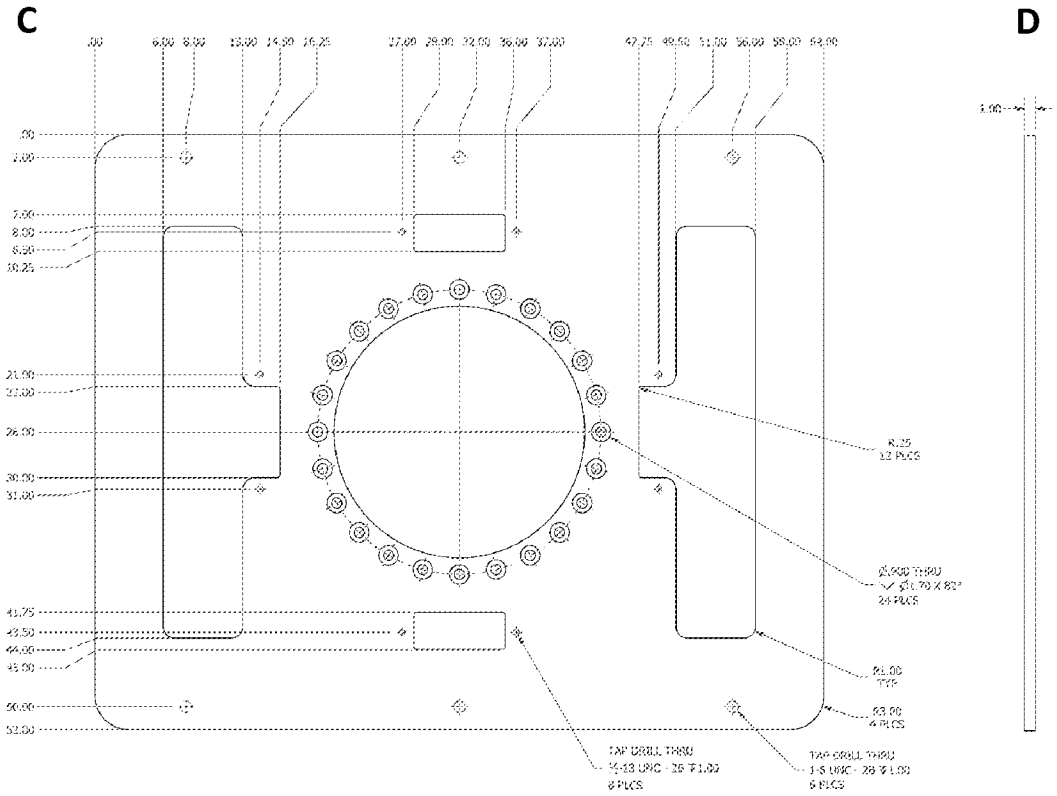

FIGS. 8C and 8D defines the measurements of a specific embodiment of the mounting plate. FIG. 8C features openings for the locking mechanism as well as removed regions of material to lighten the weight of the plate. The mounting plate is shown constructed from a single piece of material, but similar to the base plate, it may be fabricated in two halve components or four quarter components. FIG. 8D illustrates the approximate thickness of the mounting plate near about 1 inch.

Figures 8E, 8F:
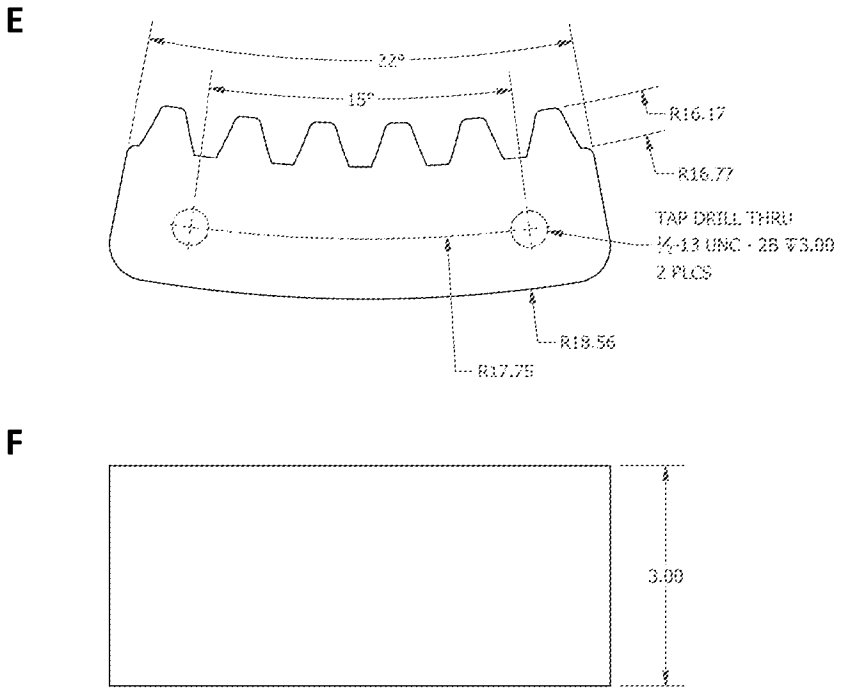

As depicted in FIGS. 8E and 8F, the key lock comprises one or more locking members projecting in a radial arc of about 22 degrees and adapted to engage with of the lock engagement members of the rotational element. Two holes are drilled into the key lock to receive an anchoring element which in this case is a hex bolt (bolt size: ½-13 UNC standard thread form). The side perspective of FIG. 8F shows the approximate height of the key lock.

Figures 8G, 8H:
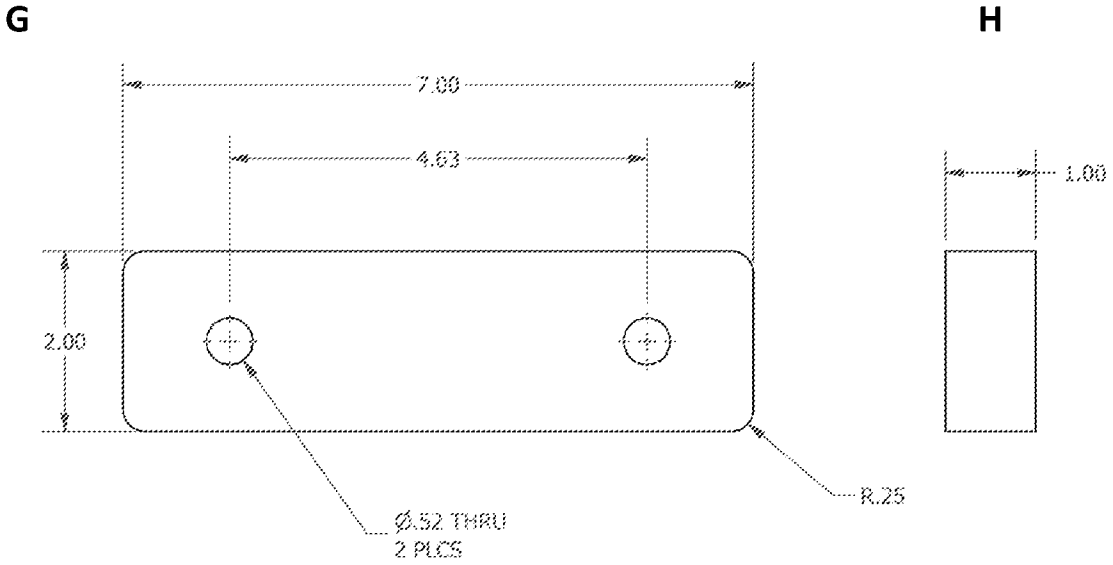

The lock spacer is shown in an overhead view in FIG. 8G with approximate size measurements designed to fit within the opening of the mounting plate with a clearance of about 0.5 inch (e.g., 0.25 to 0.75 inch) of the outer diameter of the lock spacer to the inner diameter of the locking mechanism opening in the mounting plate. In this embodiment, the lock spacer is about the same thickness of the mounting plate (FIG. 8D).

Figures 8I, 8J:
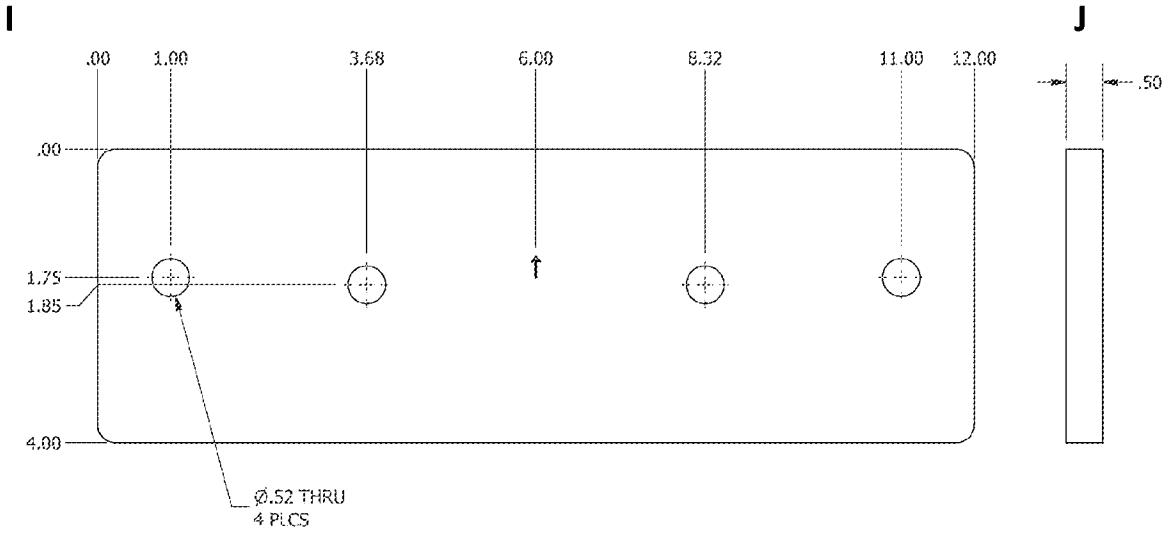

The lock plate and its relative dimensions are depicted in FIGS. 8I and 8J. The lock plate in this embodiment is about 0.5 inch to maintain a low profile when the locking mechanism is engaged. Shown in 8I, two holes are placed offset from the center of the lock plate designed to match the holes in the lock spacer and the key lock to secure all three components with anchoring elements as a single piece for use as the locking mechanism. The lock plate features two additional holes placed at positions closer to the edges of the plate which may be used to attach the engaged locking mechanism to the mounting plate with anchoring elements in a less removable manner (i.e., permanent until the anchoring elements are removed).

Reference throughout this specification to "one embodiment," "an embodiment," or similar language means that a particular feature, structure, or characteristic described in connection with the embodiment is included in at least one embodiment. Thus appearances of the phrase "in one embodiment," "in an embodiment," and similar language throughout this specification may, but do not necessarily, all refer to the same embodiment.

We claim:

1. A portable, variable orientation turntable and winch for mounting on a platform comprising:

(a) A turntable, further comprising a base plate, a plurality of attachment points, a rotational element comprising a first interface, and a second interface, a mounting plate comprising at least one opening, and a locking mechanism;

(b) A plurality of anchoring elements configured to project through at least one of the plurality of attachment points, directly interfacing with said platform so as to reversibly secure the turntable second interface to the platform so that said second interface interacts with said platform;

(c) A winch in fixed orientation on a mounting surface of the mounting plate;

wherein said plurality of anchoring elements rigidly holds said base plate to said platform;

wherein said plurality of anchoring elements rigidly holds said base plate to said platform;

wherein the first interface of the rotational element is attached to the mounting plate, and the second interface is attached to the base plate such that when the base plate is fixed to the platform, the mounting plate is rotatable around an axis perpendicular to the base plate, and said locking mechanism may be positioned to simultaneously engage the base plate and the rotating mounting plate to reversibly limit rotation of the mounting plate, and the winch is attached to the mounting plate wherein said locking mechanism may be positioned to engage said rotational element at a plurality of lock engagement elements, said plurality of lock engagement elements being dispersed circumferentially on said rotational element, and wherein at least one opening in the mounting plate exposes a subset of said plurality of lock engagement elements of the rotational element and permits the locking mechanism to enter into said opening thereby engaging with the subset of said plurality of lock engagement elements to restrict rotation of the rotational element.

2. The turntable and winch of claim 1, wherein said rotational element is comprised of at least two independently moving components to permit free rotation of the mounting plate with respect to the platform.

3. The turntable and winch of claim 2, wherein the rotational element is a slewing bearing.

4. The turntable and winch of claim 1, wherein said mounting plate allows for the removable attachment of one or more types of winches.

5. The turntable and winch of claim 1, wherein at least one of the base plate and the mounting plate is further modified by cutting away sections of plate to reduce the overall mass and weight.

6. The turntable and winch according to claim 1, wherein the locking mechanism comprises:

(a) a lock plate;

(b) a lock spacer; and (c) a key lock, further comprising one or more locking members projecting in a radial arc and adapted to restrict rotation of the rotational element;

wherein the lock plate is connected to the key lock by means of the lock spacer, and the locking members are complementary to the at least one lock engagement element of the rotational element, and when the locking members and lock engagement elements are engaged, the mounting plate and rotational element are restricted in rotation about the platform.

7. The turntable and winch of claim 6, wherein the lock mechanism is manually operated from the surface of the mounting plate to engage the at least one lock engagement element of the rotational element.

8. The turntable and winch of claim 1, wherein said plurality of attachment points are distributed about the base plate's outer perimeter and said plurality of anchoring elements equally distribute prying forces applied to the winch.

9. A low relief shipboard turntable comprising, (a) a mounting plate having at least one opening;

(b) a rotational element comprising a mounting plate interface, a base plate interface, an outer edge interface, and a plurality of lock engagement elements;

(c) a base plate comprising a plurality of attachment points distributed about the base plate's outer perimeter;

(d) a locking mechanism; and (e) a plurality of anchoring elements, each anchoring element configured to project through at least one of the plurality of attachment points;

wherein the mounting plate interface of the rotational element is attached to the mounting plate, and the base plate interface is attached to the base plate such that when the base plate is fixed to a first platform, the mounting plate is rotatable around an axis perpendicular to the base plate, and said locking mechanism may be engaged with the rotational element at one or more of said plurality of lock engagement elements to prevent rotation of the rotational element; and wherein said plurality of anchoring elements equally distribute prying forces applied to the mounting plate;

wherein the plurality of lock engagement elements are dispersed circumferentially on at least one of the mounting plate interface, base plate interface, and outer edge interface, so that said plurality of lock engagement elements and said at least one of the mounting plate interface, base plate interface, and outer edge interface are rotatable around said axis; and wherein said plurality of lock engagement elements are capable of engaging with the locking mechanism and wherein said at least one opening in the mounting plate exposes one or more of said plurality of lock engagement elements and permits the locking mechanism to enter into the at least one opening thereby engaging with one or more of said plurality of locking engagement elements to restrict rotation of the rotational element.

10. The turntable of claim 9, wherein the mounting plate is located between 2 inches to 2 feet above the first platform when the base plate is fixed to the first platform.

11. The turntable of claim 9, wherein the turntable may be relocated to a second platform or location upon disengagement of the base plate from the first platform.

12. The turntable of claim 9, wherein said mounting plate allows for the removable attachment of one or more types of winches.

13. The turntable of claim 9, wherein the locking mechanism comprises:

(a) a lock plate;

(b) a lock spacer; and (c) a key lock, further comprising one or more locking members projecting in a radial arc and adapted to restrict rotation of the rotational element;

wherein the lock plate is connected to the key lock by means of the lock spacer, and the locking members are complementary to the at least one lock engagement element of the rotational element, and when the locking members and the at least one lock engagement element are engaged, the mounting plate is restricted in rotation about the first platform.

14. The turntable of claim 13 comprising at least two locking members.

15. The turntable of claim 9, wherein at least one of the base plate and mounting plate is composed of one or more of materials selected from steel, stainless steel, aluminum, cast iron, titanium, metal alloy, mechanical grade plastic, and any combination thereof.

16. The turntable of claim 15, wherein said materials are laminated in one or more protective coatings selected from zinc, chrome plating, paint, epoxy, and any combination thereof.

17. The turntable of claim 9, wherein said plurality of engagement elements is selected from the group consisting of pins, teeth, grooves, or notches.

18. The turntable of claim 9 wherein said plurality of lock engagement elements are dispersed circumferentially on said outer edge interface.

* * * * *